US008074416B2

(12) United States Patent
Andrews

(10) Patent No.: US 8,074,416 B2
(45) Date of Patent: Dec. 13, 2011

(54) STRUCTURAL MEMBERS WITH GRIPPING FEATURES AND JOINING ARRANGEMENTS THEREFOR

(75) Inventor: William John Andrews, Cambewarra (AU)

(73) Assignee: TSF Systems, LLC

( * ) Notice: Subject to any disclaimer, the term of this patent is extended or adjusted under 35 U.S.C. 154(b) by 0 days.

(21) Appl. No.: 12/537,397

(22) Filed: Aug. 7, 2009

(65) Prior Publication Data

US 2010/0218451 A1 Sep. 2, 2010

Related U.S. Application Data

(63) Continuation of application No. 11/146,534, filed on Jun. 7, 2005, now abandoned.

(51) Int. Cl.
*E04B 2/58* (2006.01)
*E04B 2/78* (2006.01)
*E04B 2/60* (2006.01)

(52) U.S. Cl. ..... 52/241; 52/481.2; 403/230; 403/363

(58) Field of Classification Search ..... 52/241, 52/481.1, 481.2; 403/230, 363
See application file for complete search history.

(56) References Cited

U.S. PATENT DOCUMENTS

| | | | | |
|---|---|---|---|---|
| 2,173,721 | A | 9/1939 | McGee | |
| 2,843,725 | A | 7/1958 | Granberg | |
| 2,966,708 | A | 1/1961 | Freeman, Jr. | |
| 3,160,280 | A | 12/1964 | Burch | |
| 3,204,382 | A * | 9/1965 | McGurn | 52/349 |
| 3,243,930 | A * | 4/1966 | Slowinski | 52/364 |
| 3,332,197 | A | 7/1967 | Hinkle | |
| 3,492,766 | A * | 2/1970 | Andrews | 52/36.6 |
| 3,656,223 | A | 4/1972 | Maisenbacher | |
| 3,719,980 | A | 3/1973 | Van Bussel | |
| 3,743,332 | A | 7/1973 | Sonolet | |
| 3,753,324 | A | 8/1973 | Puccio | |
| 3,897,668 | A * | 8/1975 | McDonnell | 52/632 |
| 3,925,948 | A | 12/1975 | Sauer et al. | |
| 4,011,704 | A * | 3/1977 | O'Konski | 52/481.1 |
| 4,019,291 | A | 4/1977 | Ernst | |
| 4,074,487 | A | 2/1978 | Daniels et al. | |
| 4,272,930 | A | 6/1981 | Foster | |
| 4,364,212 | A | 12/1982 | Pearson et al. | |

(Continued)

FOREIGN PATENT DOCUMENTS

| | | |
|---|---|---|
| AU | 428738 | 10/1972 |

(Continued)

*Primary Examiner* — Robert Canfield
(74) *Attorney, Agent, or Firm* — Kit M. Stetina; Edward W. Callan

(57) ABSTRACT

A joining arrangement is provided for use in the construction of stud frame which includes a releasable attachment/detachment feature. The first member (plate) includes in at least one side wall a formation which, when members are joined, engages a corresponding formation in at least one wall of the second member (stud). The formation, such as a V-shaped protrusion, is/are disposed at an angle to the longitudinal axis of the member and the formation on the second member is disposed generally parallel to its longitudinal axis such that upon engagement of the first and second members, the respective formations in the first and second members engage such that they are in alignment, thereby, securing the first member to the second. Additionally, a plurality of protrusions, which provide a gripping feature, may be formed on the upper surface of web for inhibiting the stud from sliding, slipping, moving and/or migrating within the plate.

19 Claims, 8 Drawing Sheets

U.S. PATENT DOCUMENTS

| | | | | | |
|---|---|---|---|---|---|
| 4,397,127 | A | | 8/1983 | Mieyal | |
| 4,709,517 | A | | 12/1987 | Mitchell et al. | |
| 4,713,921 | A | | 12/1987 | Minialoff et al. | |
| 4,734,971 | A | | 4/1988 | Dupasquier | |
| 4,757,657 | A | | 7/1988 | Mitchell et al. | |
| 4,760,682 | A | | 8/1988 | King | |
| 4,798,029 | A | | 1/1989 | Carlton | |
| 4,854,096 | A | | 8/1989 | Smolik | |
| 4,918,899 | A | | 4/1990 | Karytinos | |
| 5,040,345 | A | | 8/1991 | Gilmour | |
| 5,079,884 | A | | 1/1992 | Menchetti | |
| 5,081,813 | A | | 1/1992 | White | |
| 5,095,678 | A | | 3/1992 | Murphy | |
| 5,127,760 | A | | 7/1992 | Brady | |
| 5,157,883 | A | * | 10/1992 | Meyer | 52/357 |
| 5,203,132 | A | | 4/1993 | Smolik | |
| 5,222,335 | A | | 6/1993 | Petrecca | |
| 5,285,615 | A | | 2/1994 | Gilmour | |
| 5,394,665 | A | | 3/1995 | Johnson | |
| 5,497,591 | A | | 3/1996 | Nelson | |
| 5,592,796 | A | | 1/1997 | Landers | |
| 5,596,859 | A | | 1/1997 | Horton et al. | |
| 5,600,991 | A | | 2/1997 | Munzen | |
| 5,660,012 | A | * | 8/1997 | Knudson | 52/241 |
| 5,685,121 | A | * | 11/1997 | DeFrancesco et al. | 52/481.1 |
| 5,692,405 | A | | 12/1997 | Kirii | |
| 5,720,138 | A | | 2/1998 | Johnson | |
| 5,729,950 | A | | 3/1998 | Hardy | |
| 5,735,100 | A | | 4/1998 | Campbell | |
| 5,797,233 | A | | 8/1998 | Hascall | |
| 5,819,578 | A | | 10/1998 | Codatto | |
| 5,930,968 | A | | 8/1999 | Pullam | |
| 6,023,898 | A | | 2/2000 | Josey | |
| 6,029,334 | A | | 2/2000 | Hartley | |
| 6,032,504 | A | | 3/2000 | Onat et al. | |
| 6,098,435 | A | | 8/2000 | Takada | |
| 6,119,430 | A | | 9/2000 | Nicholls | |
| 6,374,558 | B1 | | 4/2002 | Surowiecki | |
| 6,401,423 | B1 | | 6/2002 | Bergeron et al. | |
| 6,418,682 | B1 | | 7/2002 | Rice | |
| 6,453,627 | B1 | | 9/2002 | Powers | |
| 6,557,254 | B1 | | 5/2003 | Johnson | |
| 6,568,138 | B1 | | 5/2003 | Frost et al. | |
| 6,609,285 | B1 | | 8/2003 | Kinney | |
| 6,647,691 | B2 | | 11/2003 | Becker et al. | |
| 6,792,733 | B2 | | 9/2004 | Wheeler et al. | |
| 6,871,470 | B1 | | 3/2005 | Stover | |
| 6,964,079 | B2 | | 11/2005 | Zimmer | |
| 6,983,569 | B1 | | 1/2006 | Rosenberg | |
| 6,997,026 | B2 | | 2/2006 | Fischer | |
| 7,086,265 | B2 | | 8/2006 | Losch | |
| 7,127,862 | B2 | | 10/2006 | Saldana | |
| RE39,462 | E | | 1/2007 | Brady | |
| 7,223,043 | B1 | * | 5/2007 | Andrews | 403/363 |
| 2001/0017016 | A1 | | 8/2001 | Rudduck | |
| 2003/0033770 | A1 | | 2/2003 | Harel | |
| 2003/0089053 | A1 | | 5/2003 | Elderson | |
| 2003/0145537 | A1 | | 8/2003 | Bailey | |
| 2004/0035065 | A1 | | 2/2004 | Orszulak et al. | |
| 2004/0055232 | A1 | | 3/2004 | Jette | |
| 2004/0083665 | A1 | | 5/2004 | Surowiecki | |
| 2004/0232290 | A1 | | 11/2004 | Wilhelmsen et al. | |
| 2005/0034408 | A1 | | 2/2005 | Palumbo et al. | |
| 2005/0079034 | A1 | | 4/2005 | Maas | |
| 2005/0217344 | A1 | | 10/2005 | Losch | |
| 2006/0065345 | A1 | | 3/2006 | James et al. | |
| 2006/0144009 | A1 | | 7/2006 | Attalla | |
| 2006/0185315 | A1 | | 8/2006 | Walker | |
| 2006/0191227 | A1 | | 8/2006 | Orszulak et al. | |
| 2006/0277841 | A1 | | 12/2006 | Majusiak | |
| 2006/0283130 | A1 | | 12/2006 | Andrews | |
| 2007/0011971 | A1 | | 1/2007 | Sitkiewicz | |
| 2007/0193202 | A1 | * | 8/2007 | Rice | 52/733.2 |
| 2008/0110126 | A1 | | 5/2008 | Howchin | |

FOREIGN PATENT DOCUMENTS

| | | |
|---|---|---|
| AU | 494278 | 7/1978 |
| AU | 5482090 | 11/1990 |
| AU | B1407092 | 10/1992 |
| AU | 642828 | 10/1993 |
| AU | B6057096 | 12/1996 |
| AU | 702437 | 2/1999 |
| AU | 4528100 | 12/2000 |
| EP | 0321183 | 6/1989 |
| EP | 0752745 | 7/1995 |
| EP | 0676513 | 10/1995 |
| FR | 2870760 | 12/2005 |
| GB | 2169937 | 7/1986 |
| JP | 52101819 | 8/1977 |
| JP | 9268701 | 10/1997 |
| JP | 1-42607 | 12/1998 |
| JP | 2003293106 | 10/2003 |
| JP | 2004197804 | 7/2004 |
| JP | 2006062078 | 3/2006 |
| LV | 13363 | 12/2005 |
| NZ | 198360 | 9/1981 |
| WO | WO8810344 | 12/1988 |
| WO | WO9324712 | 12/1993 |
| WO | WO9508409 | 3/1995 |
| WO | WO9723694 | 7/1997 |
| WO | WO0014355 | 3/2000 |
| WO | WO0071827 | 11/2000 |

* cited by examiner

STRUCTURAL MEMBERS WITH GRIPPING FEATURES AND JOINING ARRANGEMENTS THEREFOR

CROSS-REFERENCE TO RELATED APPLICATIONS

The present application is a continuation patent application of U.S. patent application Ser. No. 11/146,534, filed Jun. 7, 2005, now abandoned, which is related to U.S. patent application Ser. No. 09/797,214 filed May 14, 2002, now U.S. Pat. No. 7,223,043, entitled "Structural Members and Joining Arrangement Therefor", the content of which are expressly incorporated by reference herein in its entirety.

STATEMENT RE: FEDERALLY SPONSORED RESEARCH/DEVELOPMENT

Not Applicable

BACKGROUND

1. Field of the Invention

The present invention relates to joining systems and to structural members for use in such joining systems. More particularly, the present invention relates to structural members which have gripping features formed on the lower and upper base plates which inhibit the vertically oriented stud from inadvertent slippage, movement and/or migration within the lower and upper base plates.

2. Background of the Invention

Traditionally, light weight construction of metal stud frames employs steel or aluminum stud members which are generally channel shaped and wherein the ends of the stud members engage channel shaped plate members. A standard form metal stud frame will usually comprise a series of spaced apart stud members which each engage via their ends respective opposing top and bottom plate members. According to conventional methodology, the frames are generally assembled on the ground. Typical frame construction involves placement of top and bottom plate members in spaced apart opposing relationship whereupon stud members are connected to the top and bottom plates which traditionally involves engaging the ends of the stud with tech screws or the like. These frames may or may not be braced but in the case where they are not braced with bracing members reliance for bracing is placed on tech screws. Unlike external frames, internal frames used in partitioning are not generally braced during construction as bracing is affected by wall cladding fixed to the frame. During construction, stud frames are structurally weak and in the case of internal frames, they are not effectively braced until the wall cladding is affixed to the frame. A small number of holding screws may be used to fix some studs to the top and bottom plates. Although a weak form of bracing is created by the conjunction between stud and plate members which are screwed, no reliance can be placed on the bracing of the frame as the unscrewed joins do not offer sufficient strength and resistance against slewing in the circumstance when the frame is lifted into position.

Installers screw the members together at the point of overlap between stud and plate but engagement of studs to plates with limited screwing will not of itself provide adequate bracing. The profiles of the known studs and plates are channel shaped with a planar base and sidewalls extending from and continuous with the edges of said base. Typically, a stud mates with a plate by insertion of the end of the stud into the throat of the plate. The fit is essentially friction grip and there is no resistance against separation of stud from plate until such time as tech screws are inserted.

Another method of affixation of studs to top and bottom plates involves a tab and slot arrangement in which tabs located at the extremity of the walls of the top and bottom plates engage a corresponding slot in each wall of the stud members following which the tradesman hammers the tabs so they are oriented at an angle other than normal to the walls of the stud members thereby locking the stud members against the top and bottom plates.

One advantage of this method is that more material is required to form the channel shaped top and bottom plates. Secondly, additional labor is required to bend the tabs into their locking position which can be awkward due to the position of the protruding tabs inside the channel shaped studs. Although the tab and slot method of connection of studs to plates is effective in securing the members, it is tedious and time consuming for tradesman to bend the tabs four times for each stud. The insertion of tech screws, although used in holding studs to plates during construction and until the cladding material is affixed to the stud frame is likewise time consuming and does not provide effective temporary bracing until all or the majority of the joins are screwed. Other methods of affixation of studs to plates have been used such as riveting, welding or clinching of each stud, all of which methods involve additional labor.

A further prior art method of joining structural members for a stud frame involves the use of cooperating and corresponding engaging formations in the walls of both stud and plates. The formations in the plate consist of a securing notch formed in the walls of the mating stud and plates. To facilitate stud location, the wall extremities of the plate are abbreviated by upturning of a lip formed at the extremities at the position where the stud mates with the plate. The additional material required to form the lip adds to material costs and necessitates a securing clip which adds to costs in labor and assembly. Another disadvantage of this mode of connection is that the surface area of engagement is low resulting in low resistance to relative rotation, twisting, and pulling out between stud and plate.

Another prior art method involves the engagement between a formation in the walls of the top and bottom plates and a corresponding formation in stud members. The formations are produced by pressing out of a region of the wall of each member so that the formations mate in snap fit male/female relationship. While this system works well, it necessitates an additional punching step during production which increases production time of the constituent structural members but it does not provide a useful and more convenient alternative to the tab system described above. All of the above systems rely on pre-punching and limits or removes entirely the ability of the installer to move the studs relative to plates once fitted and where adjustment may be required during construction to accommodate fit and finish errors or window or door size irregularities.

Another problem arising particularly in internal stud frame construction is irregularity in floor to ceiling height in buildings caused by poor concrete finishing and out of alignments which often necessitates cutting of stud members in regions of reduced height. In a normal stud frame, the stud members would be the same height or length but where there are irregularities in the ceiling or floor, the frame will not fit unless stud heights are suitably cut to accommodate those differences. This is time consuming and adds additional labor costs to the installation. Finally, another disadvantage of the known prior art is that the vertically oriented studs are prone to sliding, slipping, movement and/or migration within the lower base plate and upper base plate, particularly, while routing conduit through conduit ports. For instance, when the conduit is being pulled through the conduit ports formed in the vertically oriented studs, the conduit tends to catch and pull the studs from their predetermined spacing. Therefore, it would be beneficial to provide a gripping feature or the like, which will inhibit such unwanted sliding, slipping, movement and/or migration within the lower base plate and upper base plate.

BRIEF SUMMARY OF THE INVENTION

The present invention seeks to ameliorate the shortcomings of the prior art arrangements by providing an alternative method of joining structural members used in the formation of metal stud frames and the like for use in modular construction of stud frames. Preferably, the arrangements are adapted to suit internal non-load bearing stud frame partitioning. Due to the labor and additional material costs in implementation of the known methods, there is a need to provide a joining system which allows quick and efficient joining of structural members of a stud wall frame without having to use any tools such as a hammer, as previously described, and allowing quick, efficient and infinite positioning of the stud. The joining arrangements, according to the present invention, further allows convenient, releasable fixation of a stud to a plate without any further operation to secure the members after initial joining. The joining arrangements obviate the need for additional bracing once the frame is assembled and have the advantage that each stud/plate join is effectively braced due to the interengagement of profiled parts formed in the studs and plates.

The present invention also provides a stud member including an adjustable extension member which enables the length of the stud to be adjusted to accommodate on site height variations avoiding the need for installers to cut studs to accommodate misalignments.

In another broad form, the present invention comprises: a joining arrangement for use in the construction of stud frames wherein a first structural member is releasably attached to a second structural member; wherein, the first member has side walls which include a formation which when members are to be joined, engages a corresponding formation on the second member; characterized in that the formation in the side walls of the first member is disposed at an angle to its longitudinal axis and the formation on the member is disposed generally parallel to its longitudinal axis such that upon engagement of the first and second members, the respective formations in the first and second members engage, such that they are generally in alignment.

In another broad form, the present invention comprises: a joining arrangement for use in the construction of stud frames and for releasable attachment of a first member to a second structural member forming part of the stud frame; wherein, the first member includes in at least one side wall a formation which, when members are to be joined, engages a corresponding formation in at least one wall of the second member characterized in that the formation in the wall(s) of the first member is/are disposed at an angle to the longitudinal axis of the member and the formation in the second member is disposed generally parallel to its longitudinal axis such that upon press fitting engagement of the first and second members, the respective formations in said first and second members engage to secure the first member to the second member. According to a preferred embodiment, the respective formations in the first and second members allow relative movement between the first and second members in the direction of the longitudinal axis of the second member. Preferably, the joining arrangement is used in the construction of internal stud frames in such applications as partitioning.

In another broad form, the present invention comprises: a joining arrangement enabling releasable attachment of first and second structural members used in the construction of a stud frame, wherein the joining arrangement comprises a formation in the first member disposed at an angle to the longitudinal axis of the member and which engage a corresponding formation in the second member which is disposed generally in alignment with the longitudinal axis of the second member such that the respective formations in the first and second members cooperate to releasably attach the first member to the second member, wherein the joining arrangement allows relative movement between the first and second members. According to a preferred embodiment, the relative movement enables movement of the first member along a direction parallel to the longitudinal axis of the second member.

In another broad form of the present invention comprises: a joining arrangement for joining structural members for use in construction of a stud frame wherein the arrangement comprises: a formation in opposing walls of the first member which engages a corresponding formation opposing walls of the second member; wherein the formation in the walls of the first member are disposed normally to the longitudinal axis of the member and the formation in the walls of the second member are disposed in alignment with the longitudinal axis of the second member such that the respective formations in the first and second members upon engagement align and allow the first member freedom of movement relative to and in the direction of the longitudinal axis of the second member.

According to the preferred embodiment, the first member is rotated into its position of engagement with the second member and can be released by rotation in the opposite direction. Preferably, the formations in the first and second members comprise inwardly directed recesses which interfit it male/female engagement.

In another form of the present invention comprises: a structural member for use in a stud frame and which joins with top and bottom plates of the stud frame; characterized in that the member is a stud which includes an extension element capable of relative movement thereby allowing adjustment to the length of the stud to accommodate floor to ceiling height variations.

Preferably, the adjustment is telescopic wherein the extension member may be extended and retracted to adjust the length of the member to suit floor to ceiling height.

The ends of the elements may be adapted with any of the foregoing joining systems herein described but ideally would include an extension member which allows for relative longitudinal movement of a first member relative to a second member.

In its broadest form of the method aspect, the present invention comprises: a structural member for use in a building structure such as a stud frame, wherein the member comprises at least a web and sidewalls depending from the web; characterized in that the structural member further includes a formation in at least one of the walls which engages a corresponding formation in at least a second mating structural member to releasably secure the structural member to the mating member.

Preferably, the formations are disposed either parallel or normal to the longitudinal axis of the structural member and comprise a recess in the external face of at least one wall and a projection on an inside face of at least one wall wherein the internal projection is formed by the external recess.

Preferably each of the walls of said structural member have at least one formation which are the same length as one dimension of said walls. According to one embodiment, the formations are parallel to the longitudinal axis of the structural member. Preferably, the formations are located proximate the web and on opposing faces of said walls with each at the same distance from the web.

According to one embodiment, the formations are normal to the longitudinal axis of the structural member and are located at or near one or both ends of the structural member. Preferably, when the formations are parallel to the longitudinal axis of the member, the member is capable of mating with a mating member with formations which are normal to the longitudinal axis of the member, such that the members are detachably fixed to each other. According to a preferred embodiment, the structural member is telescopic and includes an outer member and an inner member, wherein the members move relative to each other such that one of the members moves between a retracted states in which is it nested in the other member and an extended states in which the member is partially or fully extended relative to said other member. Preferably, one of the members is an extension member which includes a formation which is capable of engaging a mating member. The extension member is preferably substantially shorter than the other member.

In another broad form according to the method aspect, the present invention comprises: a method of construction of a stud frame using stud frame using structural members each comprising at least a web and sidewalls depending from the web; characterized in that the members include a formation in at least one of the walls of a first of the members which engages a corresponding formation in a second member to secure the structural member to the mating member; the method comprising the steps of:

a) taking the first structural member including a formation in at least one of the sidewalls;

b) taking the second structural member the same or similar to the first structural member;

c) taking a third structural member and setting it in opposing relationship to the first member;

d) taking the second structural member, including a formation in at least one wall of the member and which is normal to the longitudinal axis the second member;

e) placing a first end of the second member into engagement with the first member and a second end of the second member into engagement with the third member such that respective formations on the first and second and the third and second members mutually engage to hold the members in detachable engagement;

f) taking a fourth and subsequent members and joining a first end of the fourth and subsequent members with the first structural member;

g) engaging a second end of the fourth and subsequent members with the third structural member;

Preferably, the method includes the further steps of repeating steps f) and g) until a stud frame of predetermined length is formed.

Preferably, the method includes the further step prior to engagement of any one or more of the fourth and subsequent members of telescopically extending the length of one or more of the fourth and subsequent members to accommodate height variations in a space defined by the first and third members. Preferably, the first and second ends of the fourth and subsequent members are positively rotated into snap fit engagement with the first and third members.

In another embodiment of the present invention, a plurality of protrusions are formed on the upper side of the web of at least one of the lower and upper base plate. The protrusions are provided to inhibit the vertically oriented stud from inadvertent slippage, movement and/or migration within the lower and upper base plates. Other exemplary embodiments and advantages of the present invention may be ascertained by reviewing the present disclosure and the accompanying drawings.

BRIEF DESCRIPTION OF THE DRAWINGS

The present invention will now be described according to preferred but non-limiting embodiments and with reference to the accompanying illustrations wherein.

DETAILED DESCRIPTION

The particular shown herein are by way of example and purposes of illustrative discussions of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings make it apparent to those skilled in the art how the several forms of the present invention may be embodied and practiced.

Figure 1:
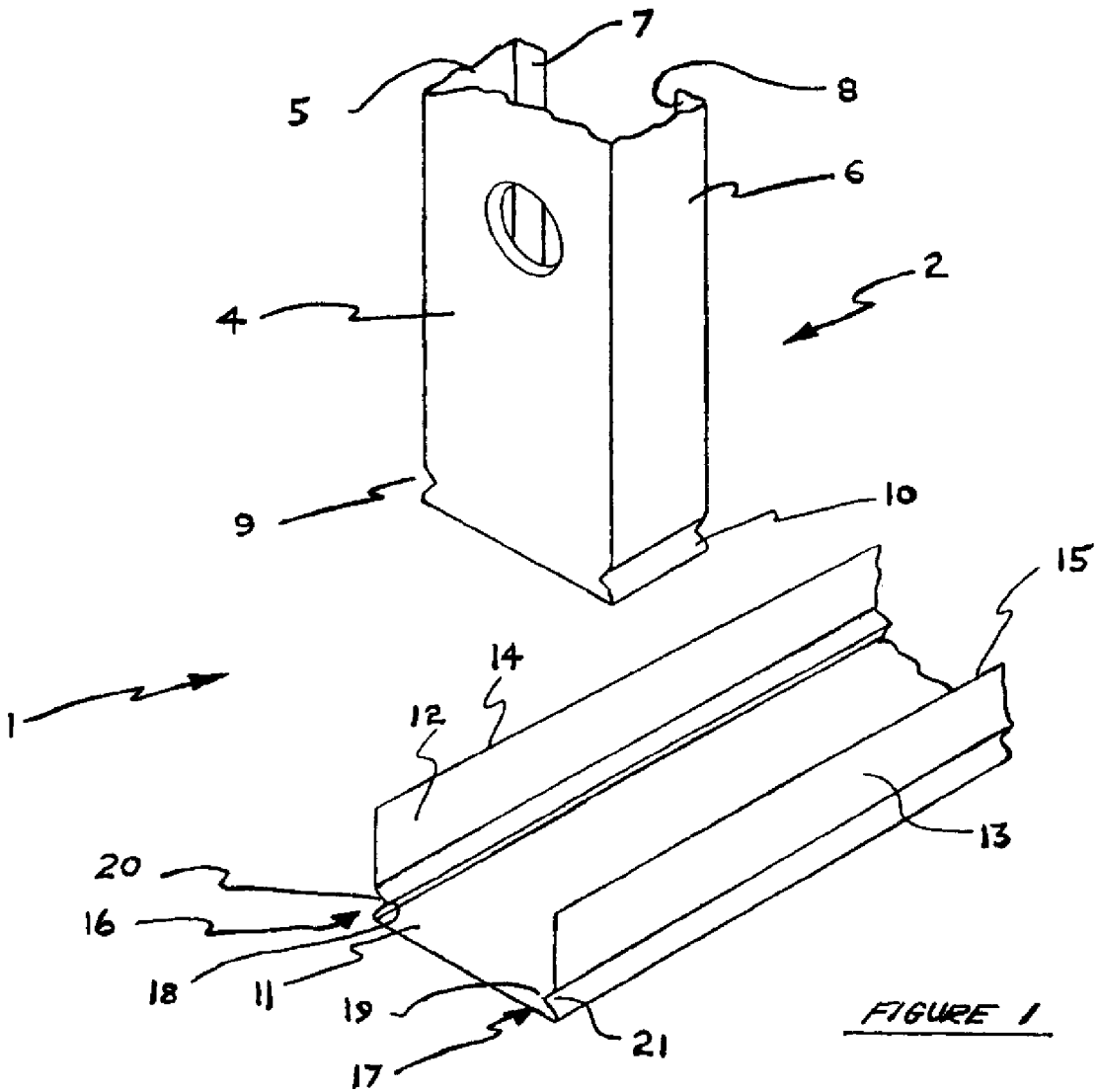
FIG. 1 shows an exploded view of a joining arrangement for two structural members including respective formations in the walls of the members according to a preferred embodiment of the invention.

Referring to FIG. 1, there is shown an exploded view of an assembly 1 for joining two structural members 2 and 3 according to a preferred embodiment of the invention. Structural member 2 is preferably channel shaped and includes a web 4 to which is connected opposing walls 5 and 6 which terminate in respective flanges 7 and 8.

Wall members 5 and 6 have formed therein respective formations 9 and 10 which each define inwardly directed recesses. Formations 9 and 10 may be introduced into member 2 by means of a roll forming step during production of member 2. In the preferred embodiment, the formations 9, 10 have a generally V-shaped cross-section. Member 2 is preferably employed as a stud for use in metal frame construction and is adapted for releasable attachment to member 3 which acts as either a top or bottom plate in a metal stud frame. Member 3 is generally channel shaped and includes web 11 to which is connected opposing walls 12 and 13 which terminate in free ends 14 and 15. Walls 12 and 13 include formations 16 and 17 defining respective inwardly directed male protrusions 18 and 19 and external female recesses 20 and 21. In the preferred embodiment, the male protrusions 18 and 19 (and external female recesses 20 and 21) have a generally V-shaped cross-section. Although respective formations 9, 10, 16 and 17 are inwardly directed, it will be appreciated by those skilled in the art that the formations may be reversed such that the male formations would project outwardly relative to the walls in which they are formed. Furthermore, the aforementioned protrusions may have other cross-sectional shapes such as semicircular, notches, or the like.

Figure 2:
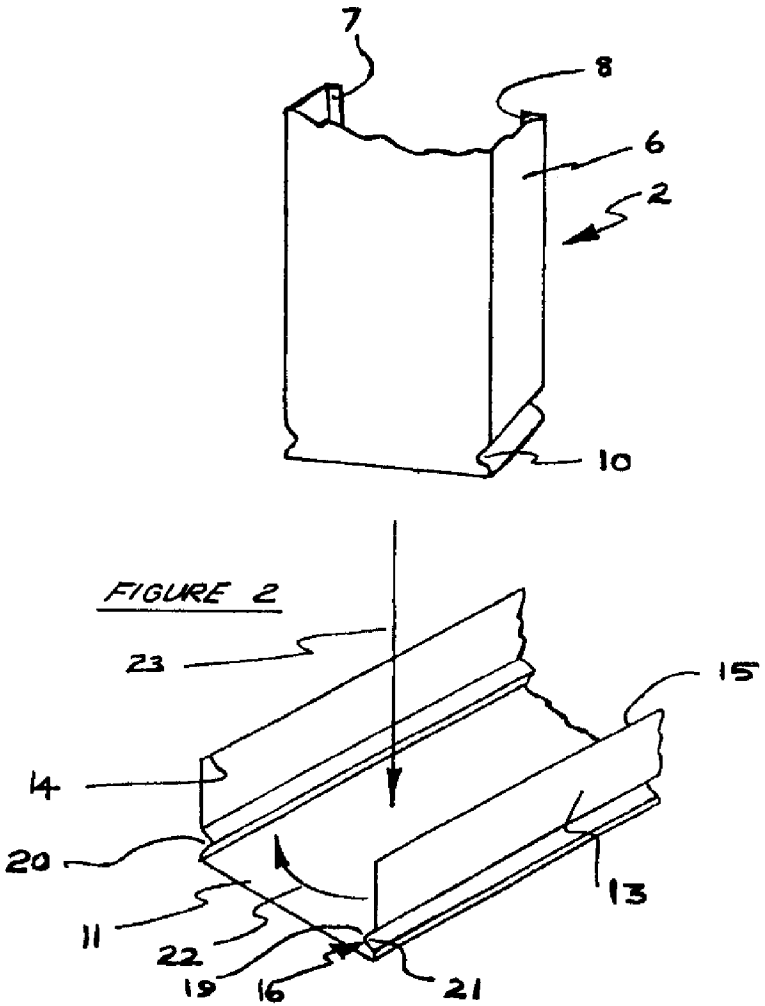
FIG. 2 shows a perspective view of respective ends of a typical stud and plate according to one embodiment of the invention prior to engagement.
Figure 3:
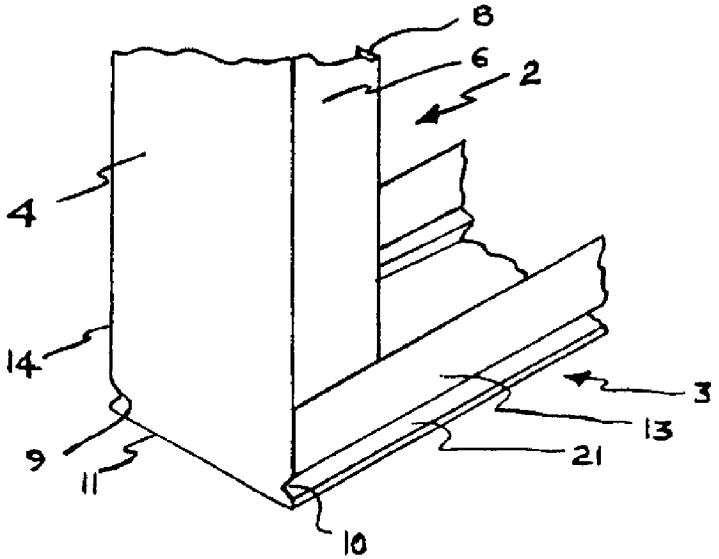
FIG. 3 shows an assembled view of the arrangement in FIGS. 1 and 2.

Referring to FIG. 2, there is shown the stud and plate arrangement of FIG. 1 showing the rotation of a stud 2 relative to plate 3 prior to mutual engagement thereof. The arrangement shown is typical of engagement between a stud and bottom plate. Engagement takes place by rotation of stud 2 in the general direction of arrow 22 to allow stud 2 to be urged into position by press fit in the direction of arrow 23. FIG. 3 shows the final engagement positions of stud 3 and plate 3. The arrangement shown in FIG. 3 is the typical engagement which would occur at locations 24 and 25 of frame 26 shown in FIG. 4.

On site, stud frames are generally assembled on the floor according to engineering plans which indicate to the assembler the positions of the stud members. The positions of the studs are critical to ensure elimination of cumulative error along the length of the frames, even spacing and to allow for locations of doors and windows. Location of the stud members is also critical to ensure that frame members match the location of joins in cladding affixed to the frames to ensure that the cladding joins are rigidly supported. Where the top and bottom plates of a stud frame are prefabricated with formations which dictate the exact location of the studs, there is no inherent flexibility in the positioning of the studs to accommodate misalignment of a cladding join with a stud. Correcting stud location for this misalignment is difficult, if not impossible, with the tab and slot joining systems and also with the existing systems employing corresponding formations pressed into the walls of the plate and stud members as relative movement between stud and plate is not available once the members are fitted.

According to the invention, the joining arrangement allows for the relative movement between stud members and top and bottom plate members to adjust for any misalignments between cladding and studs and where fine adjustments may be required to accommodate windows and doors. This is achieved by means of a snap fit connection between stud and plate which provides a strong connection yet allowing relative movement between stud and plate members so the stud may be relocated at any position along the length of the plate members. The formation in the walls of the stud may travel the full length of the member or they may be intermittent. In the latter case, the studs will be adjustable along the length of the plate over the full length of the formation. With this choice for the formation, the movement flexibility of the studs relative to the plates will either be absolute along the full length of the plate or over a predetermined distance in the stud location. In the latter case, the formation in the walls of the plate will occur over a short distance in the region of a predetermined stud position.

Figure 5:
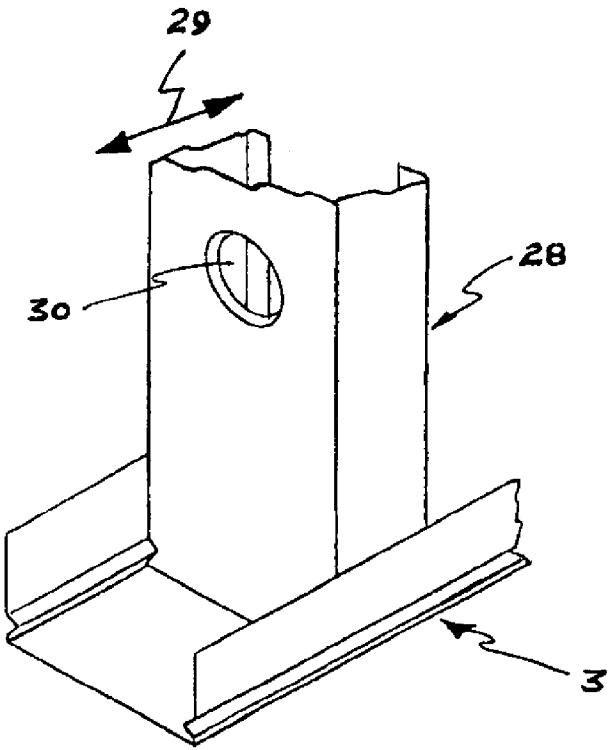
FIG. 5 shows a perspective view of an engagement between an intermediate stud and bottom plate in the frame of FIG. 4.
Figure 4:
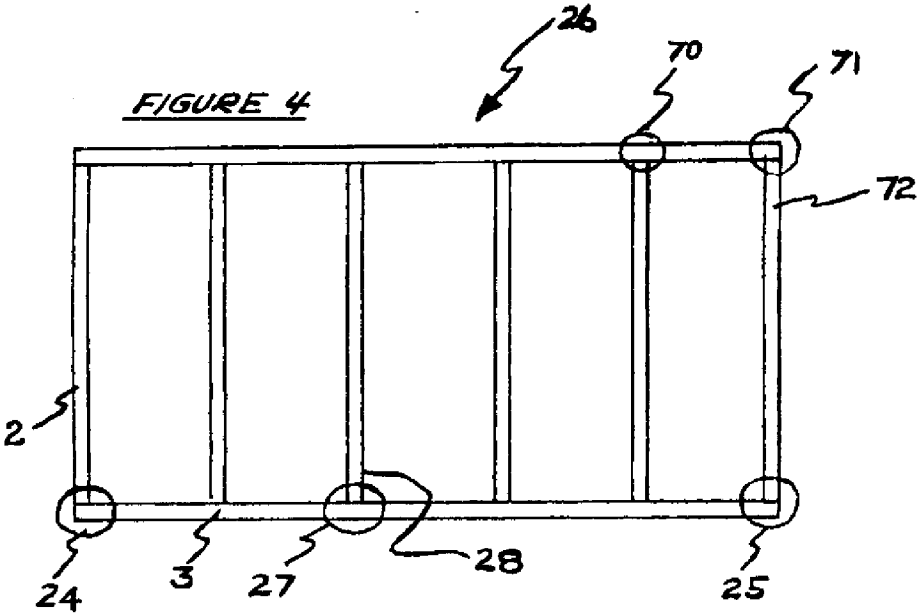
FIG. 4 shows an elevational view of a typical stud and plate frame according to a preferred embodiment of the invention.

FIG. 5 shows a perspective view of a typical intermediate joint 27 of the frame 26 of FIG. 4 in which intermediate stud 28 engages plate 3. Stud 28 is able to move longitudinally along plate 3 in the direction of arrow 29, thereby allowing fine adjustments to the position of the stud 3 to accommodate stud spacing requirements, joins in cladding or positions of windows or doors.

Figure 6:
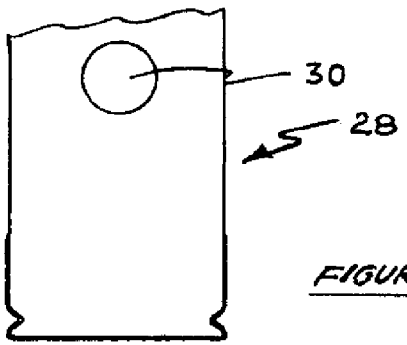
FIG. 6 shows an end view of the arrangement of FIG. 5.

FIG. 6 shows an end view of the arrangement of FIG. 5 and the nature of the mating engagement between stud 28 and plate 3. According to one embodiment, stud 28 includes an opening 30 formed therein which accommodates material such as, but not limited to, service conduits. A common problem which exists in frame installation is ceiling to height irregularities in buildings. This may occur where concrete finishing is uneven creating fit problems for stud frames. According to present methodology, this problem is addressed by cutting individual studs to fit the distance between bottom and top plates. This is time consuming during construction of frames and adds to labor costs. This problem is overcome according to one aspect of the present invention by providing an extendible stud which eliminates the need for cutting to suit ceiling to height irregularities. According to one embodiment, there is provided a telescopic stud which includes an extension member which moves between a retracted state in which the stud is a first minimum length and an extended state in which the stud is extended from the minimum length up to a maximum length.

Figure 7:
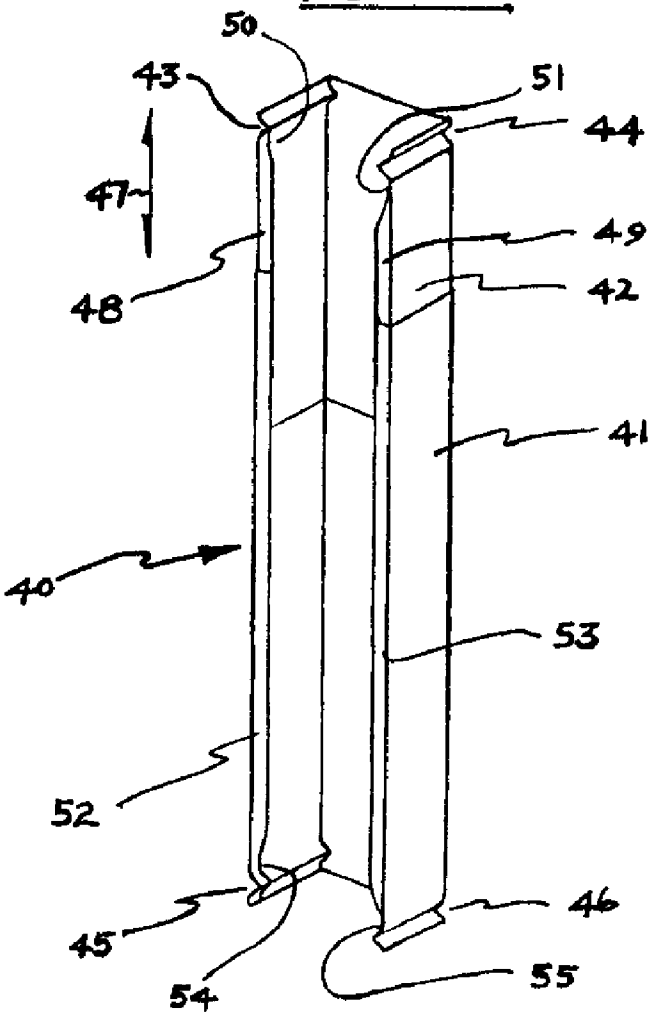
FIG. 7 shows an isometric view of a telescopic stud member according to a preferred embodiment of the invention.

FIG. 7 shows an isometric view of a structural member 40 according to a preferred embodiment including telescopic elements 41 and 42 which enable extension and retraction to a predetermined distance. Elements 41 and 42 are channel shaped and are arranged such that element 42 fits inside a channel formed by element 41.

In the event of floor to ceiling height misalignments in a structure to which a stud frame is to be fitted, member 40, due to its telescopic extension capability eliminates the need for an on site measuring and cutting where studs are formed to be too long or too short. This reduces on site time and labor costs.

According to the embodiment shown in FIG. 7, element 42 includes formations 43 and 44 and element 41 includes formations 45 and 46. These mate with corresponding top and bottom plate members according to the arrangements previously described allowing longitudinal adjustment relative to the plates in addition to vertical adjustment in the direction of arrow 47. During the cold forming of element 42, flanges 48 and 49 are crushed at regions 50 and 51 as formations 43 and 44 are introduced into element 42 Likewise, flanges 52 and 53 are crushed in the regions of 54 and 55 as formations 45 and 46 are introduced into element 41.

Figure 8:
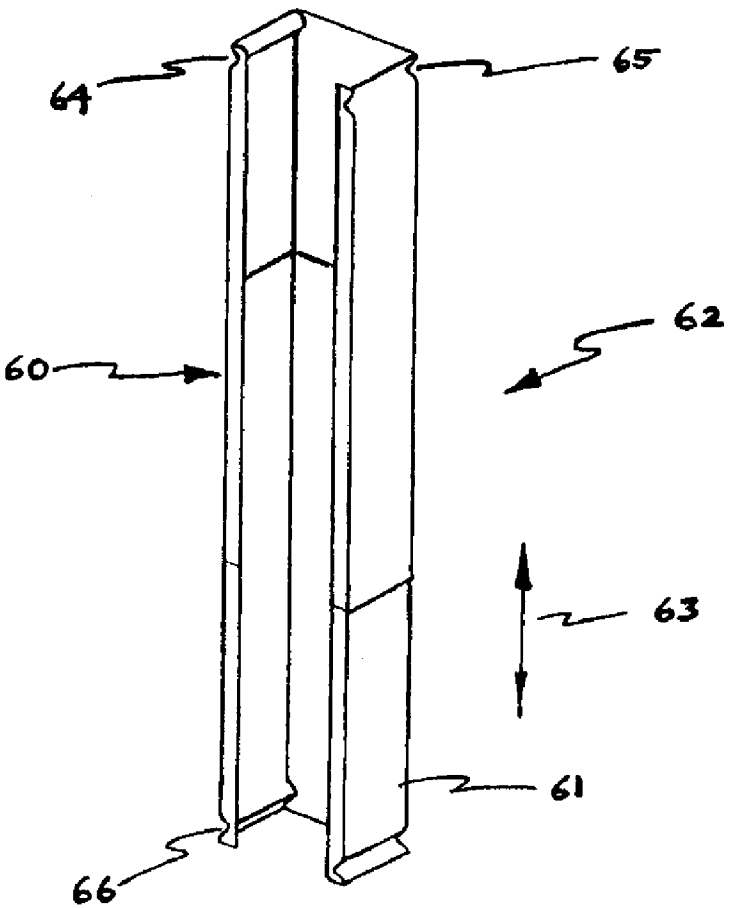
FIG. 8 shows an isometric view of a telescopic stud member according to an alternative embodiment.

FIG. 8 shows a telescopic stud element 60 according to an alternative embodiment. Stud 60 comprises elements 61 and 62 which are capable of telescopic adjustment in the direction of the arrow 63. Stud 60 further comprises an element 62, formations 64 and 65 which engage corresponding formations in a plate in a manner previously described Likewise, element 61 comprises formations 66 and 67 which will engage a bottom plate as previously described.

Figure 9:
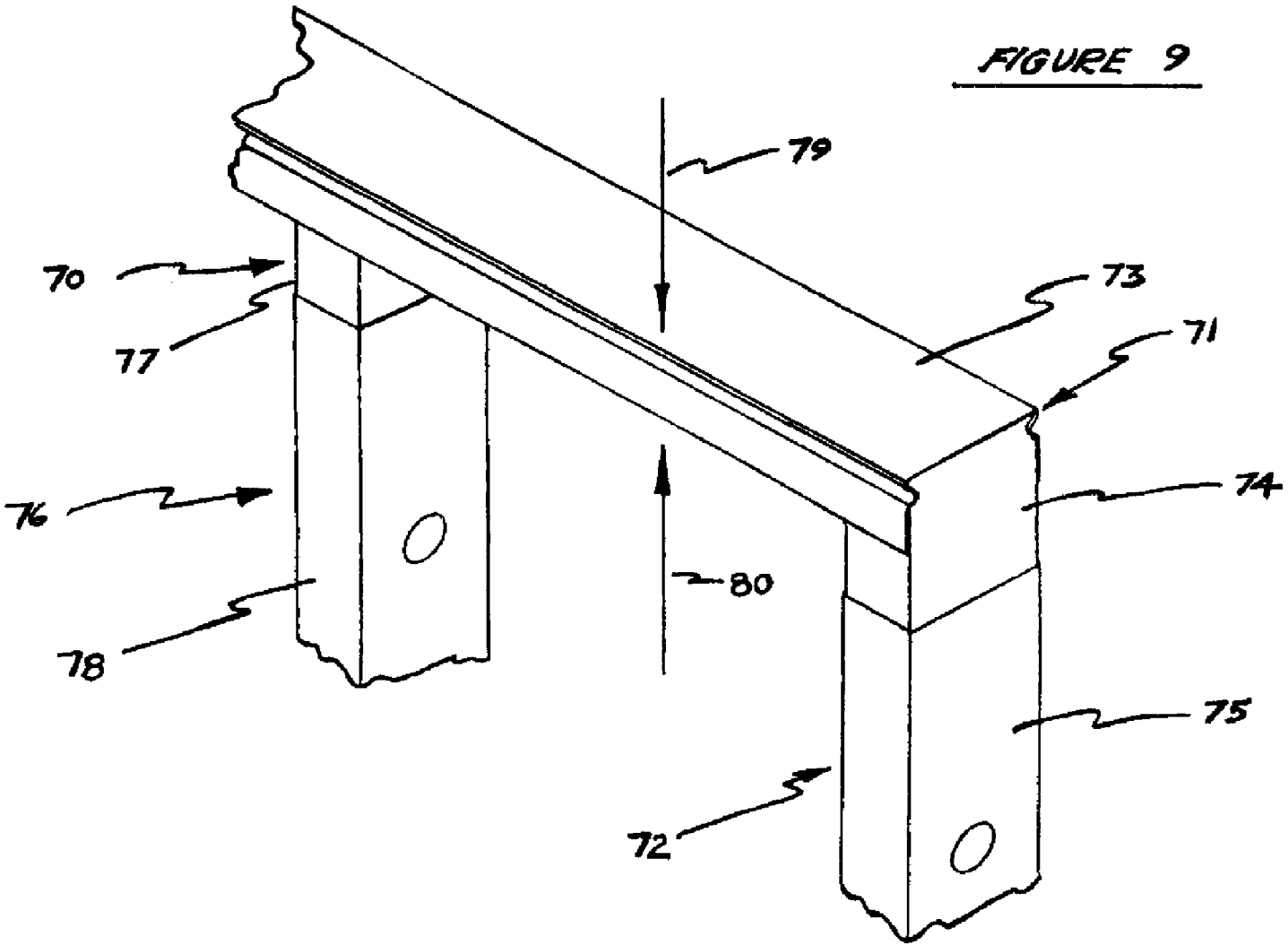
FIG. 9 shows an abbreviated perspective section of a stud frame showing mating between telescopic studs and plate according to a preferred embodiment of the invention.

FIG. 9 shows a section of the frame of FIG. 4 defined by line X-X and include junction 70 and end junction 71. Junction 71 is formed by mating of telescopic stud 72 and top plate 73. As telescopic stud 72 comprises telescopic elements 74 and 75, stud 72 may extend to increase the local height of the frame. Likewise, intermediate stud 76 which comprises elements 77 and 78 may also extend in which case that portion of the frame can be extended or retracted in the direction of arrows to accommodate height variations.

Figure 10:
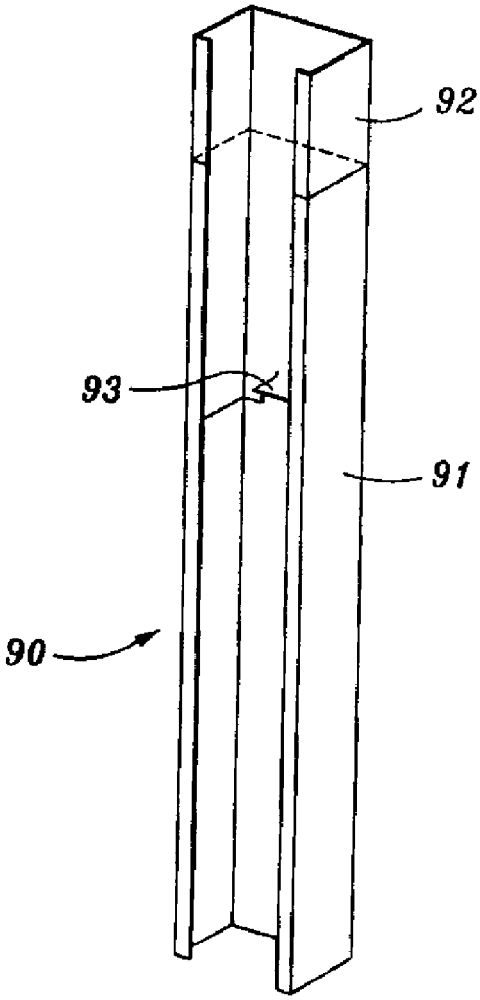
FIG. 10 shows an isometric view of a stud member according to an alternative embodiment.
Figure 10A:
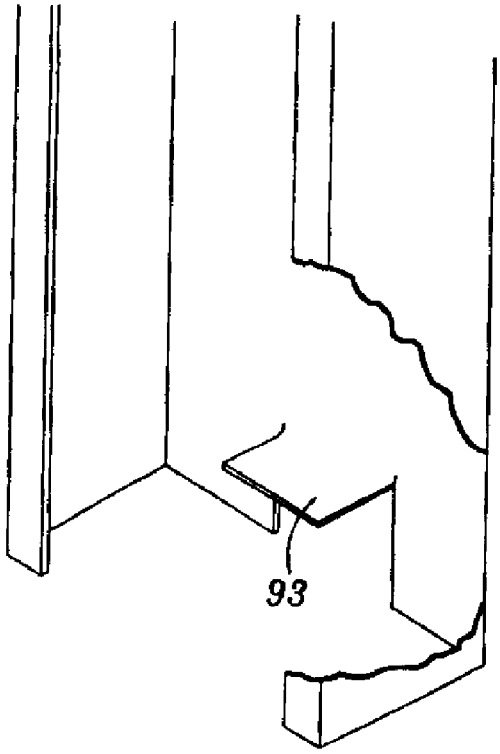
FIG. 10A shows an enlarged isometric view of the stud member shown in FIG. 10.

FIG. 10 shows an alternative stud 90 comprising telescopic elements 91 and 92. This is a more conventional stud profile without formations in the ends of elements 91 and 92 to engage with corresponding plate profiles as previously described. Element 92 includes a tab 93 which provides a bearing shoulder for urging element 92 in a direction of arrow 94 to accommodate height variations.

Figure 11:
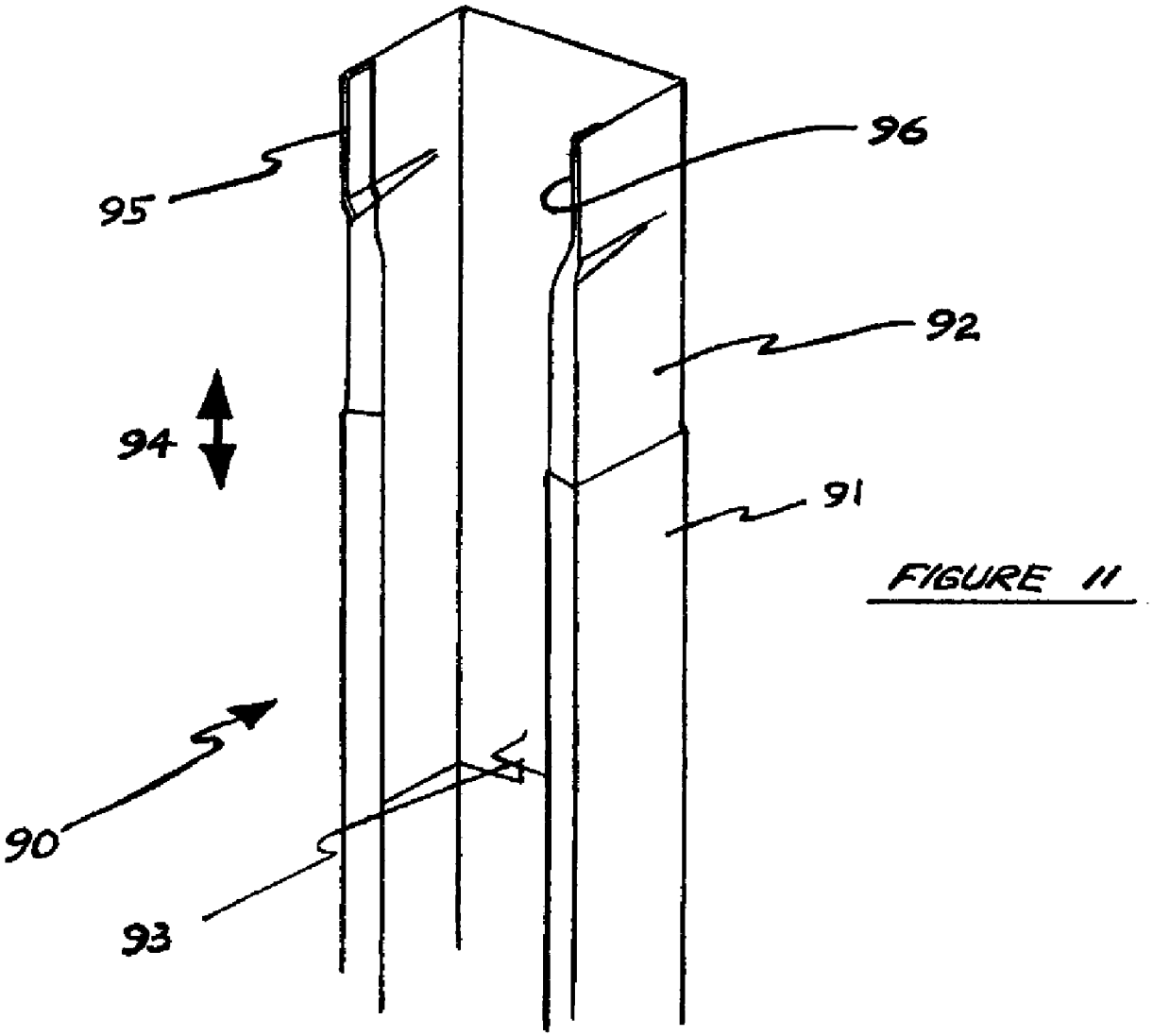
FIG. 11 shows an isometric view of a stud member including an extension member with a flared end for biased engagement with a plate.

FIG. 11 shows stud 90 of FIG. 10 including flared ends on element 92. This arrangement allows element 92 to engage a top plate with a positive bias thereby increasing frictional fit between stud and plate. This arrangement can also be introduced into the end of element 91 which would engage a bottom plate.

Figure 12:
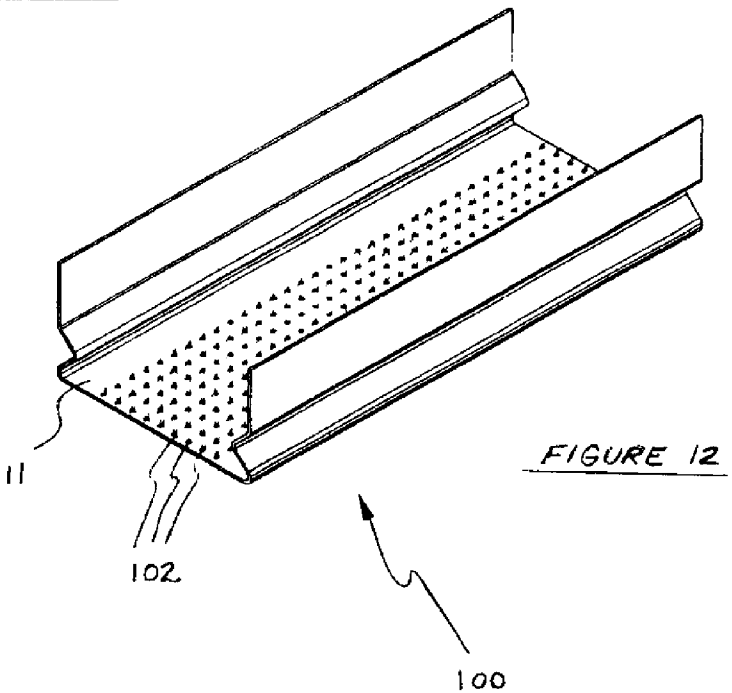
FIG. 12 shows an isometric view of another embodiment of a plate which includes a plurality of protrusions formed on the upper side of the web, according to an aspect of the present invention.
Figure 13:
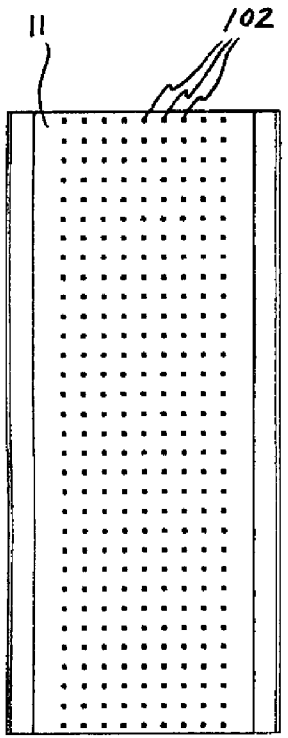
FIG. 13 shows a top view of the plate from FIG. 12.
Figure 14:
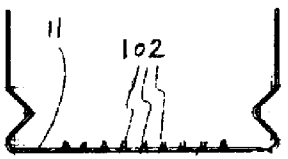
FIG. 14 shows a side view of the plate from FIG. 12.

FIGS. 12-14 show an alternative embodiment of the present invention which provides a plurality of protrusions or knurls 102 formed on the upper or exposed side of web 11 of the plate 100 which function as gripping or frictional features. Preferably, the protrusions 102 are punched from the bottom side of the web through the top side of the web such that they form a gripping surface on the top side of web 11. It is noted, however, that the protrusions, knurls or the like 102 may be formed by any other metal, forming method which accomplishes the same effect. The protrusions 102 are disposed over the length of the planar web 11 in rows that are perpendicular to the opposing walls of the horizontal plate structural member 100 and formed in the web 11 in order to inhibit the studs 2, 40, 60, 90 or the like (see FIGS. 1-11) from sliding, slipping, moving and/or migrating. For instance, the protrusions 102 will substantially prevent unwanted slippage, migration and/or movement when conduit is being run through at the opening 30 provided in the vertically oriented studs 2. It is further noted that the height, size, spacing, number protrusions per area unit may be adjusted to increase the frictional and gripping effect that the protrusions/knurls 102 provide.

It will be recognized by persons skilled in the art that numerous variations and modifications may be made to the invention as broadly described herein without departing from the overall spirit and scope of the invention. The particular shown herein are by way of example and purposes of illustrative discussions of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings make it apparent to those skilled in the art how the several forms of the present invention may be embodied and practiced.

Although the invention has been described with reference to several exemplary embodiments, it is understood that the words that have been used are words of description and illustration, than words of limitation. Changes may be made within the preview of the appended claims, as presently stated and as amended, without departing from the scope and spirit of the invention and its aspects. Although the invention has been described with reference to particular means, materials and embodiments, the invention is not intended to be limited to the particulars disclosed; rather, the invention extends to all functionally equivalent structures, methods and such uses are within the scope of the appended claims.

What is claimed is:

1. A system for interconnecting structural members, the system comprising:

a horizontal top plate structural member including a top plate planar web with a plurality of first anti-sliding protrusions formed on a first surface thereof, and a pair of opposing walls extending from the top plate planar web, the walls having inwardly directed protrusions formed along a length of the horizontal top plate structural member; and a vertical stud structural member having a first terminus end portion, the first terminus end portion of the vertical stud structural member being in contact with the first anti-sliding protrusions formed on a substantial portion of the top plate planar web of the horizontal top plate structural member, the vertical stud structural member having a pair of inwardly protruding female recesses formed on a first terminus end portion of the vertical stud structural member, the inwardly directed protrusions of the horizontal top plate structural member disposed within the female recesses of the vertical stud structural member to engage the vertical stud structural member to the horizontal top plate structural member;

wherein the first terminus end portion of the vertical stud structural member can be moved over the first anti-sliding protrusions for positional adjustment of the vertical stud structural member along the length of the horizontal top plate structural member; and wherein the first anti-sliding protrusions are disposed over the length of the top planar web in rows that are perpendicular to the opposing walls of the horizontal top plate structural member and formed to so grip the vertical stud structural member as to inhibit a positionally adjusted vertical stud structural member from sliding, slipping, moving and/or migrating over the first planar web of the horizontal structural member.

2. The system according to claim 1 wherein the vertical stud structural member has a second terminus end portion with inwardly protruding recesses formed on the second terminus end portion and the system further comprises a horizontal bottom plate structural member adapted to be positioned adjacent the second terminus end portion of the vertical stud structural member in a transverse orientation, the horizontal bottom plate structural member including a bottom plate planar web and a pair of opposing walls extending from the bottom plate planar web, the bottom plate planar web including a plurality of second anti-sliding protrusions formed on a first surface thereof, the second anti-sliding protrusions disposed over the length of the bottom planar web in rows that are perpendicular to the opposing walls of the horizontal bottom plate structural member and formed on a substantial portion of the bottom plate planar web of the horizontal bottom plate structural member and in contact with a second terminus end portion of the vertical stud structural member, and the pair of opposing walls of the horizontal bottom plate structural member having inwardly directed protrusions formed along the length of the horizontal bottom plate structural member, the inwardly directed protrusions of the horizontal bottom plate structural member being disposed within the recesses formed on the second terminus end portion of the vertical stud structural member to transversely interconnect the vertical stud structural member and the horizontal bottom plate structural member and to inhibit detachment of the vertical stud structural member and the horizontal bottom plate structural member wherein the second terminus end portion is in frictional contact with the second anti-sliding protrusions and the second terminus end portion can be moved over the second anti-sliding protrusions for positional adjustment of the vertical stud structural member along the length of the horizontal bottom plate structural member.

3. The system according to claim 2, wherein the inwardly directed protrusions and inwardly protruding female recesses have mating V-shaped cross-sections.

4. The system according to claim 1, wherein the vertical stud structural member comprises an inner and outer element, wherein the inner element is adapted to closely fit within and interface with the outer element such that the inner element may slidably move within the outer element.

5. The system according to claim 4, wherein crushed regions are formed on inwardly projecting flanges substantially proximate the inwardly protruding female recesses on the vertical stud structural member.

6. The system of claim 1 wherein the first anti-sliding protrusions are disposed between the walls of the horizontal top plate structural member.

7. The system of claim 1 wherein the first anti-sliding protrusions have a knurl configuration.

8. The system of claim 1 wherein the walls of the horizontal top plate structural member are generally parallel to each other.

9. The system of claim 1 wherein the inwardly directed protrusions are formed continuously along a substantial portion of the length of the horizontal top plate structural member.

10. The system of claim 1 wherein at least a portion of the inwardly directed protrusions of the horizontal top plate structural member are skewed with respect to the top plate planar web of the horizontal top plate structural member.

11. The system according to claim 1, wherein an opening is formed in the vertical stud structural member; and wherein the anti-sliding protrusions substantially prevent unwanted slippage, migration and/or movement when a conduit is being run through the opening in the vertical structural member.

12. A system for interconnecting structural members, the system comprising:

a horizontal structural member including a first planar web with a plurality of anti-sliding protrusions formed on a first surface thereof, and a pair of opposing walls extending from the first planar web, the walls having a first retaining portion extending toward the opposing wall at a skewed angle with respect to the first planar web; and a vertical structural member having a first terminus end at least partially disposed between the first planar web and the first retaining portion for transversely interconnecting the horizontal structural member and the vertical structural member, the vertical structural member having a first retaining surface wedged against the first retaining portion of the horizontal structural member to bias the first terminus end of the vertical structural member toward the first surface of the horizontal structural member and to bias the first terminus end of the vertical structural member against the anti-sliding protrusions formed on the first surface of the horizontal structural member to inhibit the vertical structural member from sliding along a longitudinal length of the horizontal structural member;

wherein the vertical structural member can be moved over the anti-sliding protrusions for positional adjustment of the vertical structural member along the length of the horizontal top plate structural member; and wherein the anti-sliding protrusions are disposed over the length of the web in rows that are perpendicular to the opposing walls of the horizontal structural member and formed to so grip the vertical structural member as to inhibit a positionally adjusted vertical structural member from sliding, slipping, moving and/or migrating over the first planar web of the horizontal structural member.

13. The system of claim 12 wherein the first retaining portion and a second retaining portion of the horizontal structural member forms a V shaped inwardly directed protrusion.

14. The system of claim 13 wherein a spine of the inwardly directed protrusion defined by a junction of the first and second retaining portions extends a substantial length of the horizontal structural member along a longitudinal direction of the horizontal structural member.

15. The system according to claim 12, wherein an opening is formed in the vertical structural member; and wherein the anti-sliding protrusions substantially prevent unwanted slippage, migration and/or movement when a conduit is being run through the opening in the vertical structural member.

16. The system according to claim 12, wherein the anti-sliding protrusions have a knurl configuration.

17. A system for interconnecting structural members, the system comprising:

a horizontal structural member including a first planar web with a plurality of anti-sliding protrusions formed on a first surface thereof, and a pair of opposing walls extending from the first planar web; and a vertical structural member having a first terminus end at least partially disposed between the first planar web and the opposing sidewalls of the horizontal structural member for transversely interconnecting the horizontal structural member and the vertical structural member;

wherein the vertical structural member can be moved over the anti-sliding protrusions for positional adjustment of the vertical structural member along the length of the horizontal structural member; and wherein the anti-sliding protrusions are disposed over the length of the web in rows that are perpendicular to the opposing walls of the horizontal structural member and formed to so grip the vertical structural member as to inhibit a positionally adjusted vertical structural member from sliding, slipping, moving and/or migrating over the first planar web of the horizontal structural member.

18. The system according to claim 17, wherein an opening is formed in the vertical structural member; and wherein the anti-sliding protrusions substantially prevent unwanted slippage, migration and/or movement when a conduit is being run through the opening in the vertical structural member.

19. The system according to claim 18, wherein the anti-sliding protrusions have a knurl configuration.

* * * * *